US010807134B2

(12) United States Patent
Kipping et al.

(10) Patent No.: US 10,807,134 B2
(45) Date of Patent: Oct. 20, 2020

(54) METHOD AND DEVICE FOR CONTROLLING A PARAMETER OF A ROLLED STOCK

(71) Applicant: SMS group GmbH, Düsseldorf (DE)

(72) Inventors: Matthias Kipping, Herdorf (DE); Ralf Seidel, Dillenburg (DE); Johannes Alken, Siegen (DE); Torsten Müller, Kreuztal (DE); Magnus Treude, Bad Berleburg (DE)

(73) Assignee: SMS group GmbH, Düsseldorf (DE)

( * ) Notice: Subject to any disclaimer, the term of this patent is extended or adjusted under 35 U.S.C. 154(b) by 211 days.

(21) Appl. No.: 15/735,266

(22) PCT Filed: Jun. 8, 2016

(86) PCT No.: PCT/EP2016/063045

§ 371 (c)(1),
(2) Date: Dec. 11, 2017

(87) PCT Pub. No.: WO2016/198457

PCT Pub. Date: Dec. 15, 2016

(65) Prior Publication Data

US 2018/0169724 A1 Jun. 21, 2018

(30) Foreign Application Priority Data

Jun. 11, 2015 (DE) ..... 10 2015 210 680

(51) Int. Cl.
*B21B 37/32* (2006.01)
*B21B 1/22* (2006.01)
(Continued)

(52) U.S. Cl.
CPC ..... *B21B 37/32* (2013.01); *B21B 1/22* (2013.01); *B21B 37/74* (2013.01); *B21B 2027/103* (2013.01)

(58) Field of Classification Search
CPC ..... B21B 37/32; B21B 1/22; B21B 37/74; B21B 2027/103; B21B 2027/62;
(Continued)

(56) References Cited

U.S. PATENT DOCUMENTS 4,741,193 A * 5/1988 Kimura ..... B21B 27/10 72/201
5,212,975 A * 5/1993 Ginzburg ..... B21B 27/10 239/562
(Continued)

FOREIGN PATENT DOCUMENTS

DE 36 16 070 A1 12/1986
DE 36 16 070 C2 12/1990
(Continued)

OTHER PUBLICATIONS

English translate (JP2005334910A), retrieved date Jan. 4, 2020.*
(Continued)

*Primary Examiner* — Adam J Eiseman
*Assistant Examiner* — Mohammed S. Alawadi
(74) *Attorney, Agent, or Firm* — Maier & Maier, PLLC

(57) ABSTRACT

A method and a device for controlling a parameter, for example the profile or the flatness, of a rolled stock in strip form. A cooling jacket that can be brought up to the roll and is designed to be variable in its effective length b in the circumferential direction of the roll is used as a final controlling element.

7 Claims, 13 Drawing Sheets

(51) Int. Cl.
*B21B 37/74* (2006.01)
*B21B 27/10* (2006.01)

(58) Field of Classification Search
CPC ..... B21B 27/06; B21B 27/10; B21B 2267/12; B21B 2268/19
USPC ..... 72/201
See application file for complete search history.

(56) References Cited

U.S. PATENT DOCUMENTS

| | | | | |
|---|---|---|---|---|
| 6,164,110 | A * | 12/2000 | Seidel | B21B 37/32 72/201 |
| 6,733,284 | B2 * | 5/2004 | Butsch | B05D 1/28 101/32 |
| 2012/0031159 | A1 * | 2/2012 | Seidel | B21B 27/10 72/6.2 |

FOREIGN PATENT DOCUMENTS

| | | | | |
|---|---|---|---|---|
| DE | 10 2009 053 073 | A1 | | 9/2010 |
| DE | 10 2012 202 340 | A1 | | 6/2013 |
| DE | 10 2012 216 570 | A1 | | 11/2013 |
| DE | 10 2012 219 722 | A1 | | 11/2013 |
| EP | 2 114 584 | A1 | | 11/2009 |
| EP | 2 114 584 | B1 | | 9/2011 |
| JP | S62-45409 | A | | 2/1987 |
| JP | 2005-334910 | A | | 12/2005 |
| JP | 2005334910 | A | * | 12/2005 |
| WO | 2010/099925 | A1 | | 9/2010 |

OTHER PUBLICATIONS

Written Opinion of the International Search Authority dated Aug. 12, 2016 of corresponding International application No. PCT/EP2016/063045; 6 pgs.
International Search Report dated Dec. 8, 2017 of corresponding International application No. PCT/EP2016/063045; 8 pgs.

* cited by examiner

METHOD AND DEVICE FOR CONTROLLING A PARAMETER OF A ROLLED STOCK

FIELD

The invention relates to a method and a device for controlling a parameter, for example the profile or the flatness of a strip-shaped rolled stock, in particular a metal strip, rolled by means of a roll stand.

BACKGROUND

Such methods and devices are known in principle from prior art. The basic principle of similar control will be explained next with reference to FIG. 13.

FIG. 13 shows a known cascade method for controlling for example the profile or the flatness of a metal strip with the adjustment of the thermal roller ball contour. For the sake of simplicity, only the parameters will be discussed below instead of making a distinction between a profile and flatness.

As shown in FIG. 13, the actual value, which is to say the parameter of the rolled stock, is first measured for the purposes of parameter control at the output of the controlled distance, which is to say in particular at the output of the roll stand. After the measurement by means of the parameter measuring device 110, the actual parameter $P_{actual}$ of the rolled stock is supplied to a parameter comparison device 120 and compared therein to a predetermined target parameter $P_{target}$. The difference between the target and the actual parameter is designated as a control deviation eP. This parameter control deviation eP is used by a target current determination device 130 to determine a target value $\dot{Q}_{abtarget}$ for the target of the heat to be discharged from the roller. In addition to the parameter control deviation eP, also taken into account by the target current determination device 130 will be typically also further predetermined requirements for the rollers obtained from the rolling process for determination of the target value $\dot{Q}_{abtarget}$ or of an equivalent value. This value is compared in a heat flow comparison device 140 to a target value $\dot{Q}_{abtarget}$ which has been established in advance for the current that is to be dissipated from the rollers in order to calculate from this the difference in the form of a so called heat flow control deviation $e\dot{Q}$. The actual value $\dot{Q}_{abactual}$ is determined directly or indirectly for the flow of the heat to be dissipated from the roller by means of a corresponding actual heat measuring device 170. The roll stand with the rollers 300 for rolling the rolled stock 200 represents the controlled segment 180 in FIG. 13. Furthermore, FIG. 13 shows a controller 150, which is designed to generate a control signal s as a function of the received heat flow control deviation $e\dot{Q}$. The control signal is used to control an actuator 160 in such a way that the heat flow control device will be zero as much as possible. According to prior art, for an actuator is typically used the volume of the flow, or the pressure of the cooling medium, which are employed for the cooling of the rollers in the roll stand, wherein the volume of the flow or the pressure of the cooling medium are in particular adjusted by means of a suitable actuator 165 as a function of the control signal s.

The cooling that is used according to prior art as cooling that is coupled to the control is as a rule spray cooling. Its disadvantage is the low heat transfer between the roller and the coolant. A large amount of the cooling must be kept in circulation for an optimal cooling result.

An alternative for removing a heat amount from a roller of a roll stand that is known from prior art is to use the so-called cooling jackets. These are circular jackets that are curved in the cross-section whose curvature is adapted to the curvature or the diameter of the roller to be cooled.

The use of cooling jackets for cooling rollers is known for example from the German patent application 10 2012 216 570 A1, DE 10 2012 202 340, DE 10 2009 053 073 or the European Patent Application EP 2 114 584 A1.

In order to vary the amount of the heat that is removed, it is known from prior art that a change of the height of the gap h between the cooling jacket and the roller, (which technologically means the pressure or the volume of the flow of the coolant in the gap), causes a direct change of the pressure or of the volume of the flow of the cooling and a change of the temperature of the coolant.

The change of the gap height h is structurally very complex. The exact measurement of the gap height for an active integration in the control can be realized only with difficulties and it therefore so far not been realized in practice.

A change of the pressure/volume of the flow has proven to be ideal for setting a default; however, the efficiency must be further increased to obtain a flexible control actuator.

To change the temperature of the cooling is also conceivable for use as a control actuator; however, this is very slow and very expensive.

SUMMARY

Based on this state of the art, the objective of the invention is to provide an alternative method and an alternative device for controlling a parameter of a rolled strip with the aid of a roll stand.

This is characterized in that a roller of the roller stand is arranged as a cooling jacket for the control signal, wherein the cooling jacket is formed variable in its effective length in the circumferential direction of the roller, and so that the effective length of the cooling jacket is suitably adjusted with the aid of the control signal as a function of the parameter-control deviation. Suitable in this case means that the parameter-control deviation is as close to zero as possible.

The heat flow cannot be measured directly. Therefore, when a measurement of the heat flow or a measurement that is conducted for the heat flow is mentioned in the text, this means a computational determination with an evaluation of measured temperature differences, in this case between the supplying and draining of the coolant.

The claimed variation of the effective length of the cooling jacket in the circumferential direction of the roller enables a simple, quick and cost-effective alternative for a variation of the heat amount to be discharged from the roller in a more energy-efficient manner.

The cooling jacket is typically provided with a cross-section in the form of a section of a circular arc that is used to cover a surface area of the roller.

According to a first embodiment, the determination of the control signal has the following sub-steps: determining a target value for the flow of the heat to be discharged from the roller based on the previously determined parameter control deviation, while optionally taking into account also other requirements of the rolling process on the cooling of the roller; determining the actual flow of the heat that is actually discharged from the roller; determining a heat flow control deviation as a difference between the target value and the actual value for the flow of the heat to be discharged from the roller; and determining the control signal for adjusting the effective length of the cooling jacket in the circumferential direction in accordance with the heat flow control deviation, which is in turn dependent on the parameter control deviation. The goal of the cascade control according to the invention is that in addition to the parameter control deviation, the heat flow control deviation will be also reduced to zero.

The effective length of the cooling jacket is increased in the circumferential direction when the target value of the heat flow to be discharged is greater than the actual value, and vice versa. The effective length of the cooling jacket can remain unchanged in the circumferential direction when the target value of the heat flow is equal to the actual value.

The invention proposes essentially three different embodiments for a concrete realization of the effective length of the cooling jacket in the circumferential direction of the roller:

According to a first embodiment, the cooling jacket is divided into at least a first and a second cooling segment, which are respectively provided with a cross-section in the form of a circular arc for covering a surface area of the roller. In order to adjust the effective length of the cooling jacket in the circumferential direction of the roller, the first and the second cooling jacket segment are shifted in accordance with the control signal relative to each other in the circumferential direction. Of particular importance is in this case at least a partial overlapping of the first and of the second cooling jacket segment.

A second embodiment provides that the cooling jacket is formed from a flexible material, which makes it possible to adjust the effective length of the cooling jacket in the circumferential direction of the roller by bending at least parts of the cooling jacket of the roller away from or towards the roller, or by winding or unwinding the flexible material in accordance with the control signal.

According to a third embodiment, the cooling jacket is provided with at least one rotatable flap, which enables adjusting the effective length of the cooling jacket in the circumferential direction in such a way that the flap is opened or closed according to the control signal.

The parameters that are considered within the context of the present invention are typically physical quantities, which are considered in the width direction of the rolled stock. Specifically, the parameter may be the profile of the rolled stock in the width direction, or the distribution of the flatness of the rolled stock in the width direction.

The method can be carried out during an ongoing operation of the roll stand; however, preferably/optionally it can be also carried out during rolling pauses. In both cases, the method makes it possible to discharge in an advantageous manner a defined heat amount from the roller.

The advantages of this solution are the same ones as those listed above with respect to the advantages mentioned in connection with the claimed method.

In order to optimize the adjustment of the heat amount that is to be discharged from the roller over its axial length, which is to say to make it possible to achieve the desired distribution of the heat amount in the axial direction over the width distribution of the heat to be discharged from the roller, the present invention further provides that a plurality of cooling jackets are arranged next to each other in the axial direction of the roller and these individual cooling jackets can be individually adjusted with respect to their effective length in the circumferential direction of the roller.

BRIEF DESCRIPTION OF THE FIGURES

Further embodiments of the method according to the invention and of the device according to the invention are the subject matter of dependent claims.

A total of 13 figures are attached to the invention, which show the following.

DETAILED DESCRIPTION OF THE FIGURES

The invention will be next described in detail with reference to said FIG. 1 through 12 in the form of embodiments. The same technical elements are designated with the same reference symbols in all of the figures.

Figure 1:
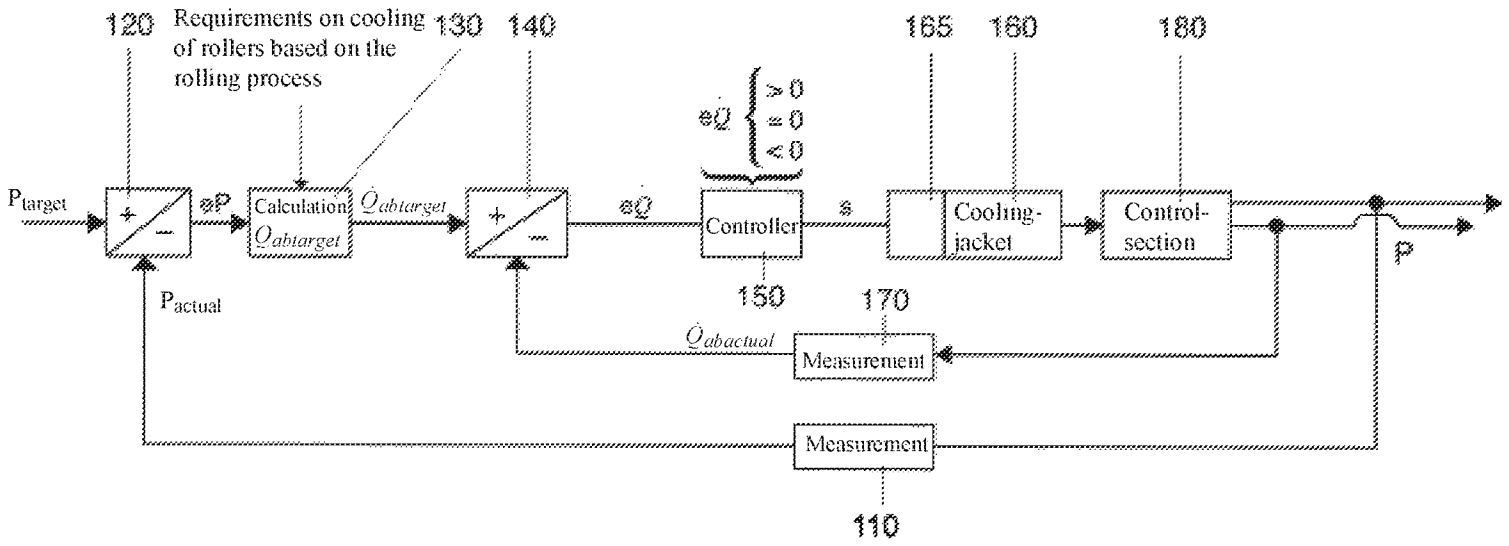
FIG. 1 a control diagram of the present invention for controlling a parameter of a rolled stock.

FIG. 1 shows cascade control for controlling a parameter of a metal strip, used for example to control its profile or its flatness. The description of FIG. 13 in the introduction of the present description is referred to with respect to the basic operation of cascade control.

Figure 13:
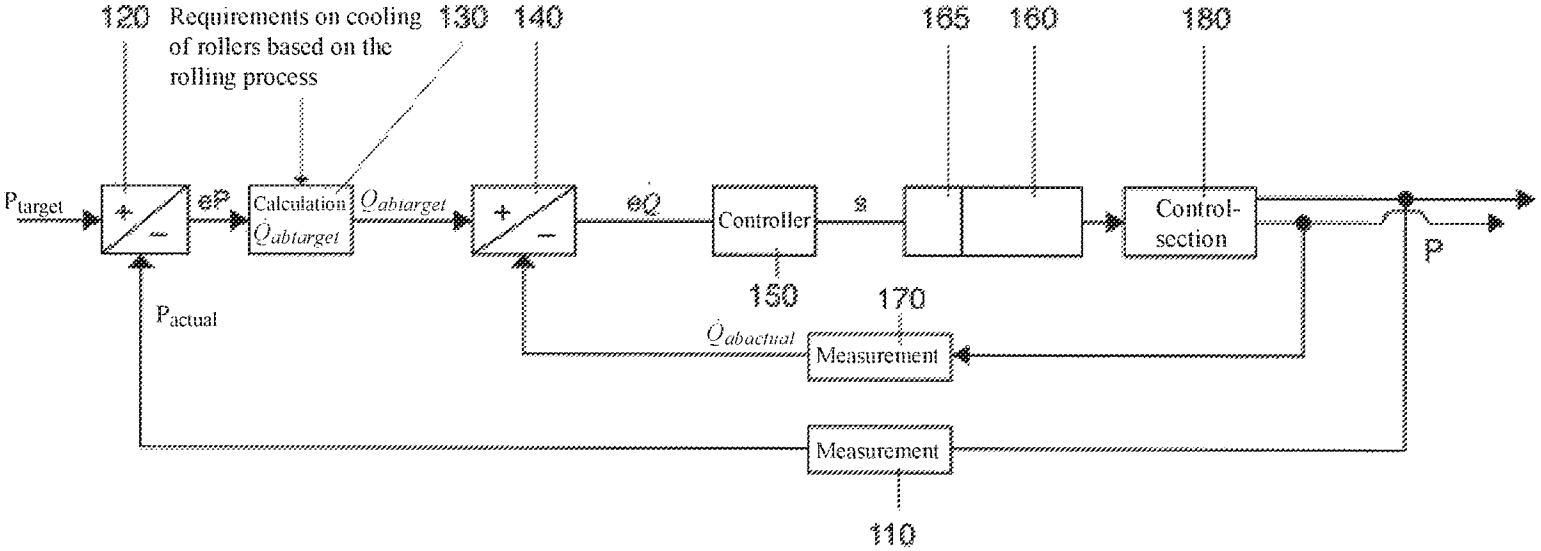
PRIOR ART Fig. 13
FIG. 13 control diagrams for controlling a parameter of a rolled stock according to the prior art.

Unlike according to the known cascade control shown in FIG. 13, the cascade control according to this invention shown in FIG. 1 is provided with a special actuator 160. The actuator 160 is a cooling jacket which is formed with a circular cross-section. The cooling jacket is placed at a distance against the surface of a roller to be cooled in a roll stand, so that a cooling gap is created between the cooling jacket and the surface of the roller for the cooling passing through it. The cooling jacket is formed in its cross-section preferably complementarily to the outer contour or to the cross-section of the roller.

The cooling jacket according to the invention is formed as a variable and adjustable cooling jacket with the aid of an actuator 165 in its effective length in the circumferential direction of the roller. By means of a signal s which is generated by the controller 150, the effective length of the cooling jacket 160 is suitably adjusted in the circumferential direction of the roller depending on the heat flow control deviation $e\dot{Q}$. Suitably means in this context that the heat flow control deviation $e\dot{Q}$ is as close to zero as possible. The heat flow control deviation $e\dot{Q}$ is in its turn dependent on the parameter control deviation eP, as described in the introduction with reference to FIG. 13. With the control according to the invention, in addition to the heat flow control deviation, the parameter control deviation should be also zero as much as possible.

For this purpose, the effective length of the cooling jacket 160 is increased in the circumferential direction of the roller when the target value $\dot{Q}_{abtarget}$ of the heat flow to be output from the roller is greater than the measured value $\dot{Q}_{abactual}$ and vice versa. On the other hand, the effective length of the cooling jacket in the circumferential direction can remain unchanged when the target value $\dot{Q}_{abtarget}$ of heat flow to be output from the roller is equal to the actual value $\dot{Q}_{actual}$ of the heat flow that is output.

Figure 2:
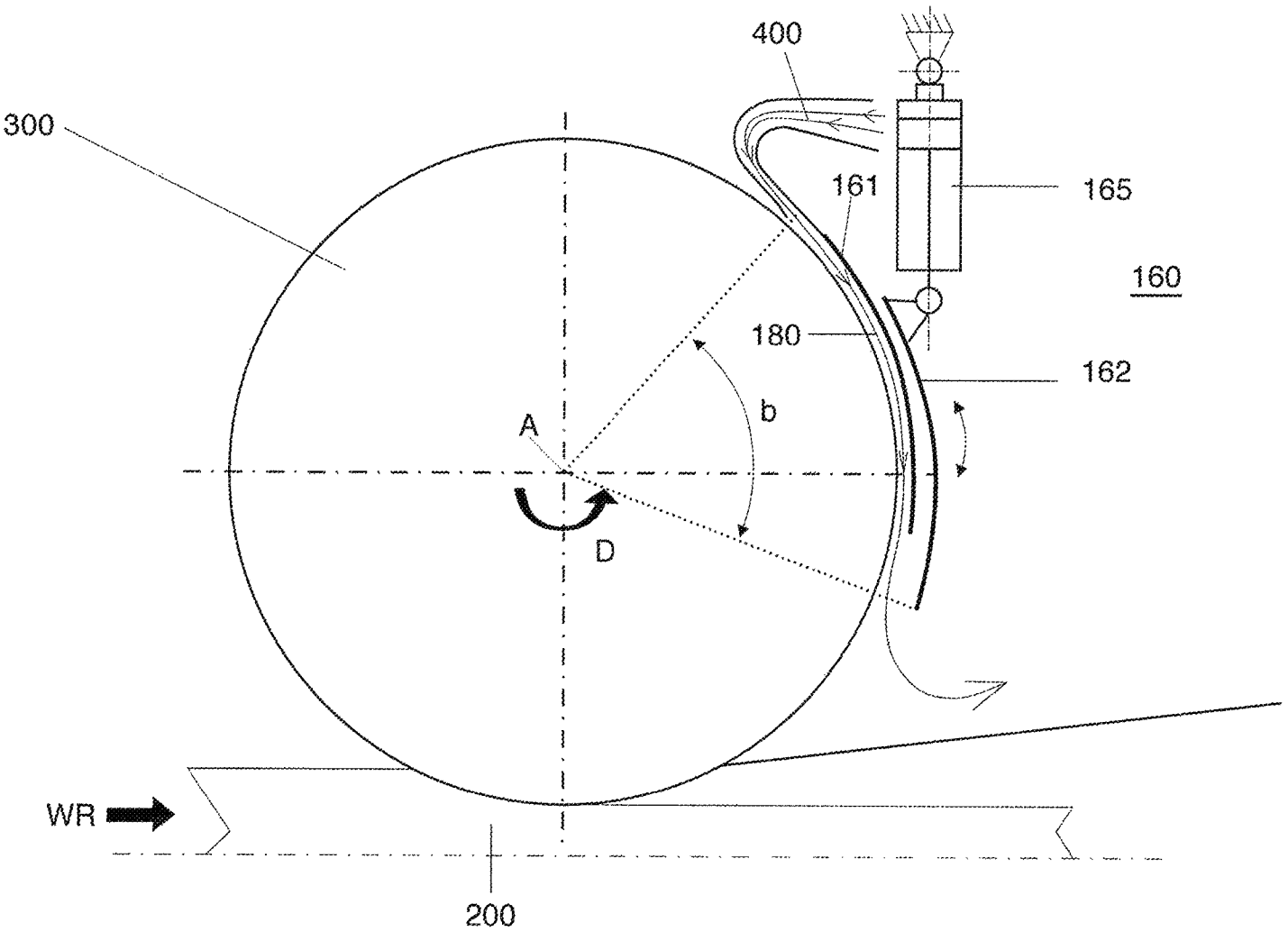
FIG. 2 a first embodiment of the cooling jacket according to the invention provided with an adjusted shorter effective length and with a first variant for the actuator.

FIG. 2 shows a first embodiment of the cooling jacket according to the invention. Accordingly, the cooling jacket 160 is provided with at least a first and a second cooling segment 161 and 162, which are respectively provided with a first cross-section in the form of a section of circular arc for covering a surface area of the roller.

With the aid of the actuator 165, which is designed in the first variant shown in FIG. 2 as a hydraulic cylinder, the two cooling jacket segments 161, 162 can be moved relative to each other in the circumferential direction of the roller 300 according to the control signal s in order to adjust in this manner the entire effective length b of the cooling jacket 160 in a suitable manner in accordance with the control signal s. The effective length b is in the present description always represented by the angle or by the corresponding length of the arc shown in FIG. 2 and in the following figures. The reference symbol A designates the rotational axis of the roller 300 and the reference symbol D designates its rotational direction during the rolling of the rolled stock 200, which is moved in the rolling direction WR.

It can be also seen from FIG. 2 that both cooling jackets 161, 162 are always arranged at a distance to the outer surface of the roller 300, so that a cooling gap is formed between the cooling jacket segments and the surface of the roller 300. To this cooling gap 180 is supplied a coolant 400, which flows through the cooling gap in or counter to the direction which is indicated by the arrow. The cooling effect is essentially determined by the effective length b of the cooling jacket 160 or of the cooling jacket element 161, 162. The greater the effective length b, the greater is also the cooling output, which is to say the more heat can be discharged from the roller 300. FIG. 2 shows the first embodiment of the cooling jacket 160 with a relatively short effective length b, because both cooling jacket elements 161, 162 are largely or greatly overlapping in the position which is shown in FIG. 2.

Figure 3:
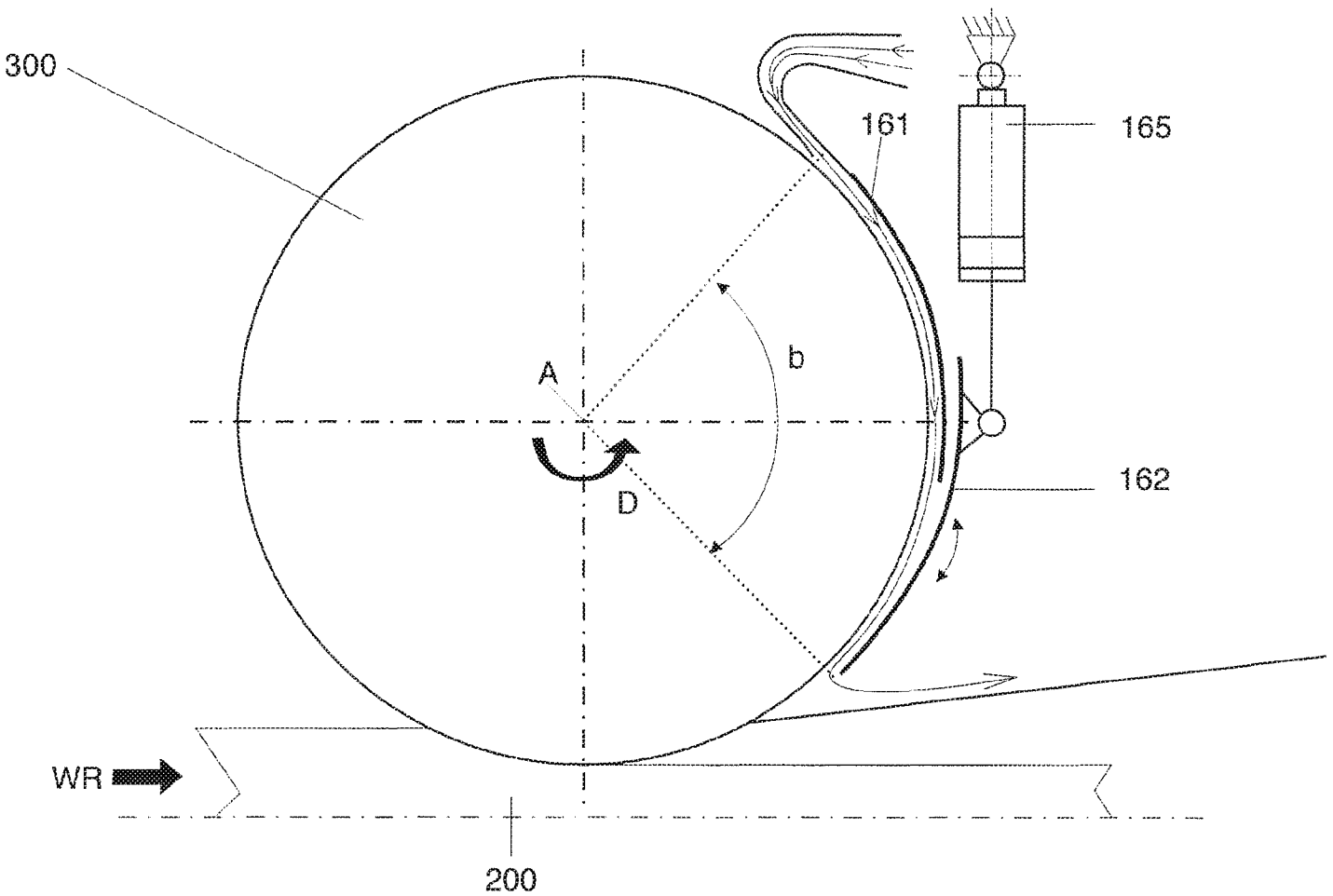
FIG. 3 the first embodiment of the cooling jacket according to FIG. 2 provided with an adjusted longer effective length.

FIG. 3, on the other hand, shows the first embodiment with the first variant for the actuator 165 in a working position, in which the two cooling jacket elements 161 and 162 are much less overlapping compared to the working position shown in FIG. 2, and in which the effective length b is therefore increased.

Figure 4:
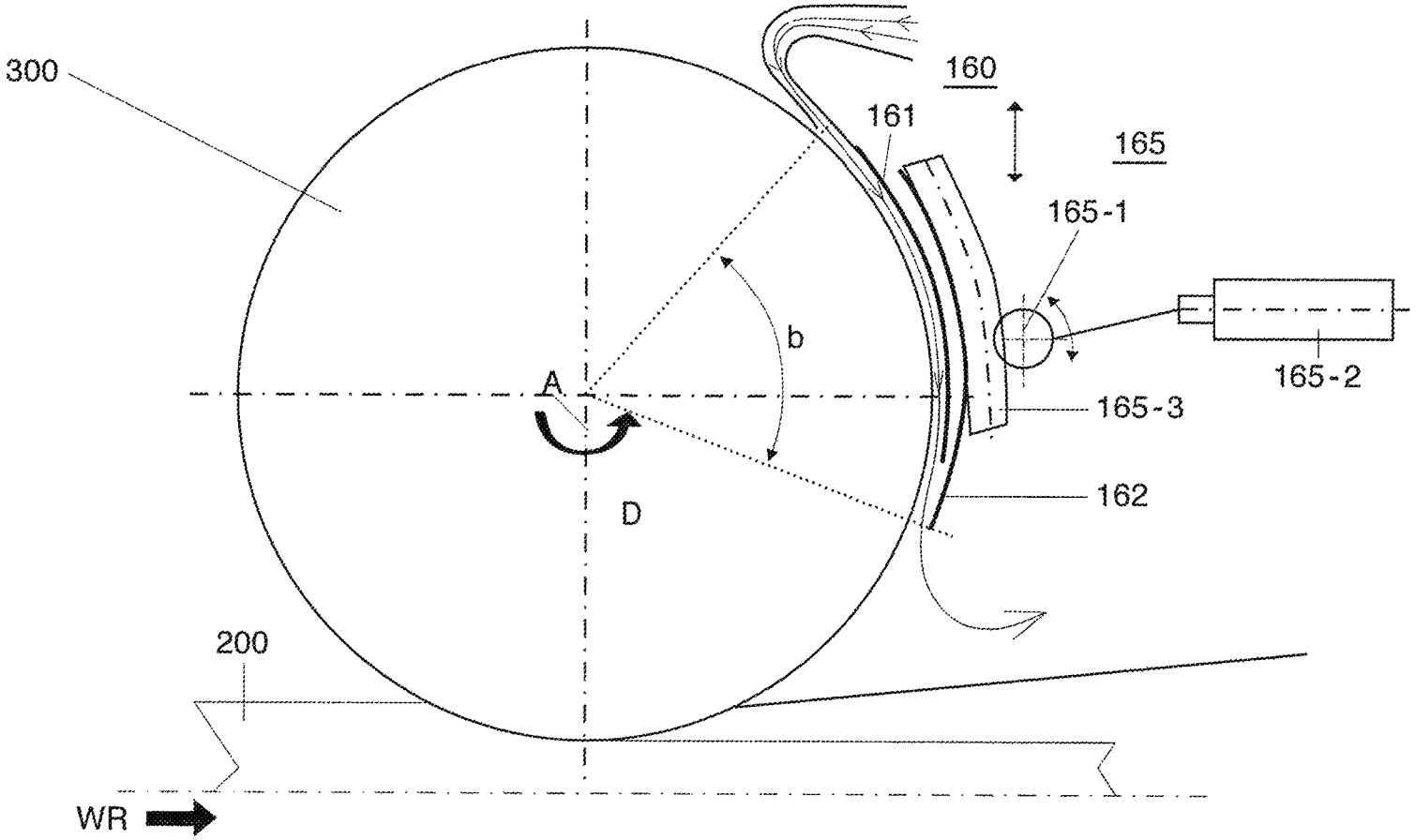
FIG. 4 the first embodiment of the cooling jacket according to the invention provided with an adjusted shorter effective length and with a second variant for the actuator.

FIG. 4 shows the first embodiment of the cooling jacket with a second variant for the actuator 165. Unlike in the first variant, the actuator or the displacement device 165 according to FIG. 4 has a more complicated construction. The displacement device comprises a rotatably mounted wheel 165-1, as well as an associated drive device 165-2 for rotatable driving of the wheel. The wheel 165-1 is in turn coupled to the second cooling jacket segment 162, for example with a coupling element 165-3, with frictional engagement or with positive engagement in such a way that a rotational movement of the wheel 165-1 causes shifting of the second cooling jacket 162 in the circumferential direction of the roller 300 relative to the cooling jacket segment 161. FIG. 4 shows the cooling jacket 160 with the two cooling jackets 161, 162 in a working position with a relatively short effective length.

Figure 5:
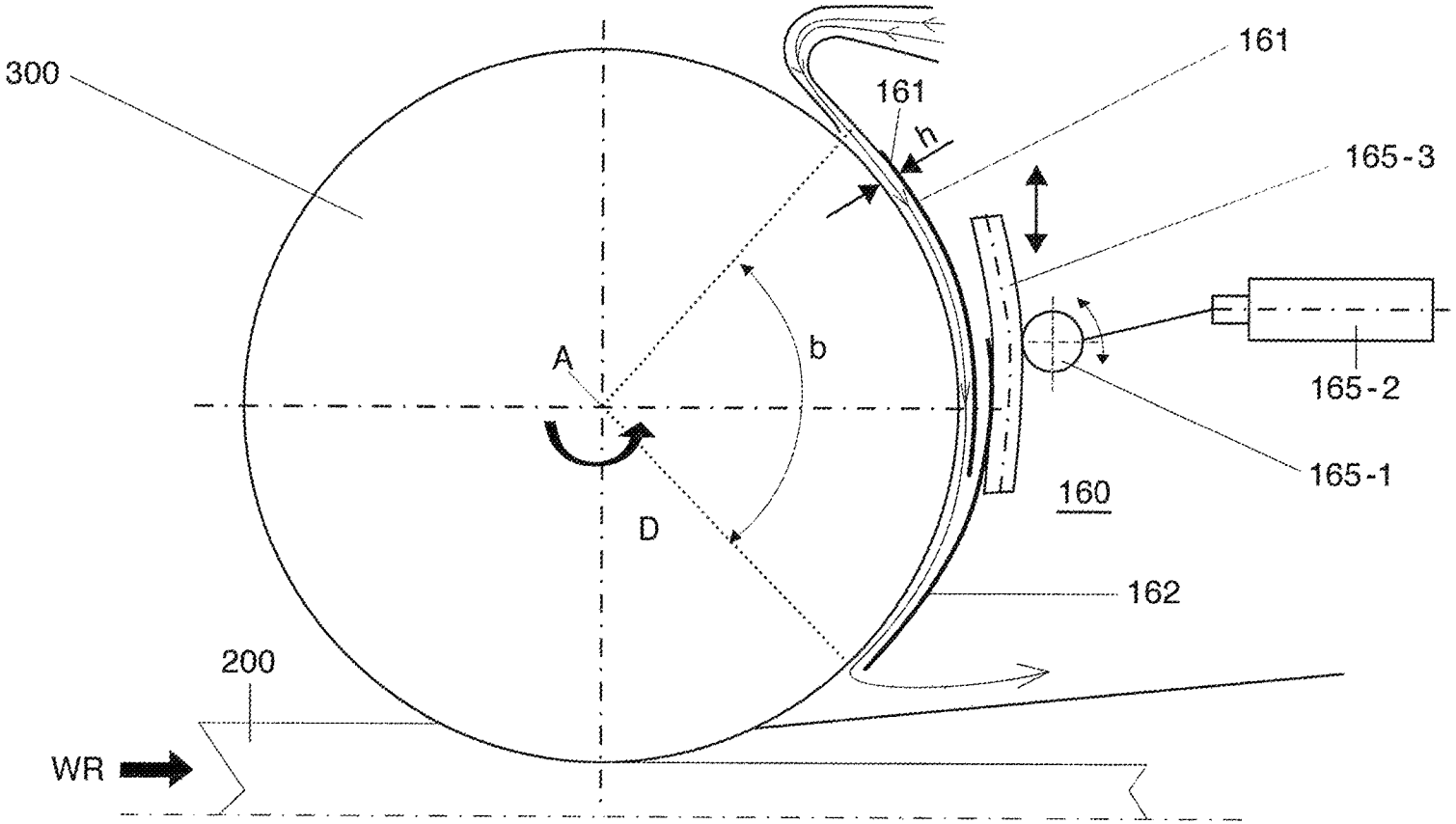
FIG. 5 the first embodiment according to FIG. 4 provided with an adjusted longer effective length.

FIG. 5, on the other hand, shows the first embodiment of the cooling jacket with the second variant of the displacement device 165 in a working position with an increased effective length b.

In all FIGS. 2 through 5, the first cooling jacket segment 161 is arranged in a fixed manner relative to the roller 300 with respect to the first embodiment.

Figure 6:
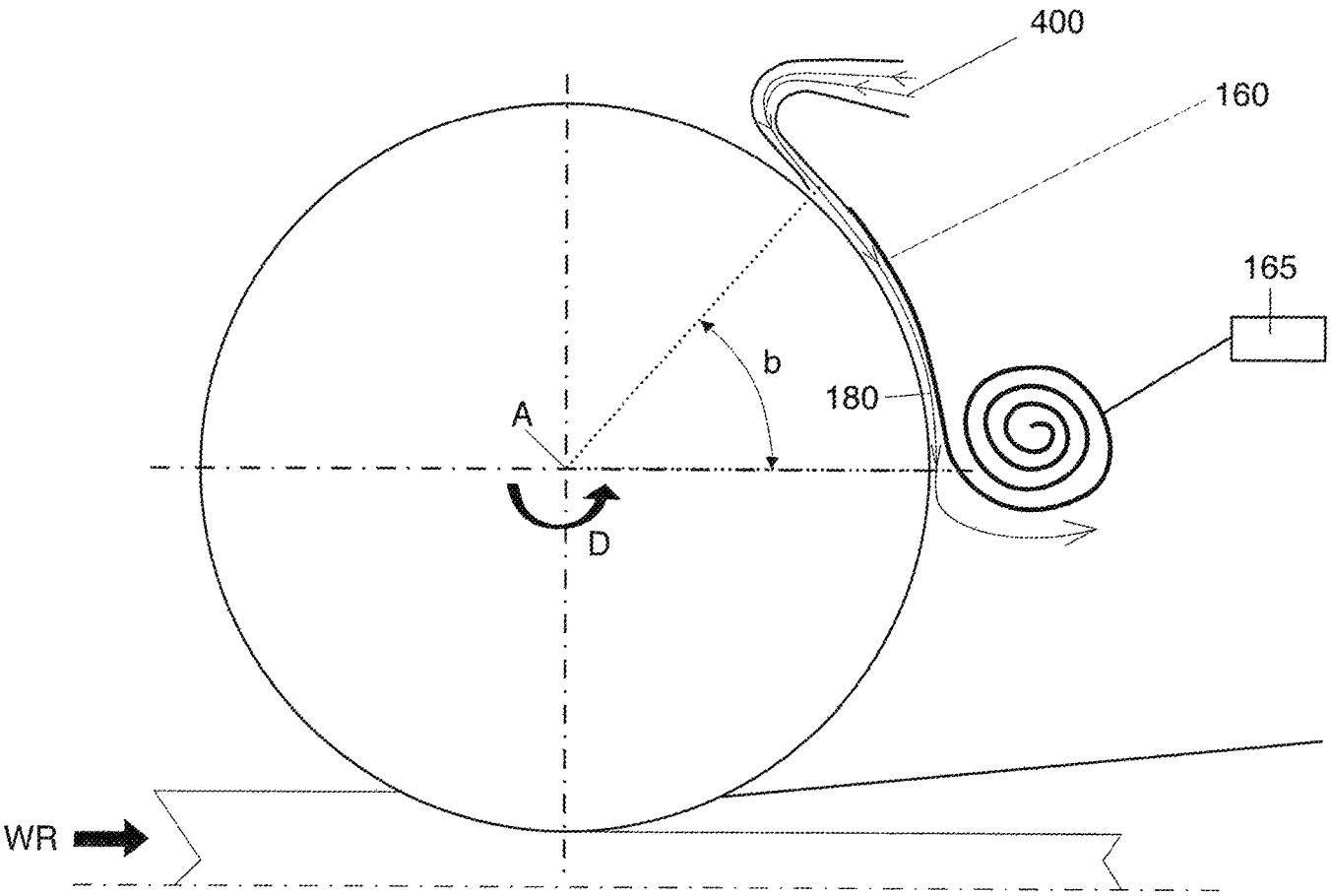
FIG. 6 a second embodiment according to the invention for the cooling jacket provided with an adjusted short effective length.

FIG. 6 shows a second embodiment of the cooling jacket 160 according to the invention, which is formed from a flexible material. The actuator 165 is in this case designed as a bending device, or as a winding and unwinding device for adjusting the effective length b of the cooling jacket 160 in the circumferential direction of the roller 300. Specifically, the actuator 165 is used, for example, for winding up with a rolling motion the flexible cooling jacket 160 in order to create a relatively short effective length b of the cooling gap 180.

Figure 7:
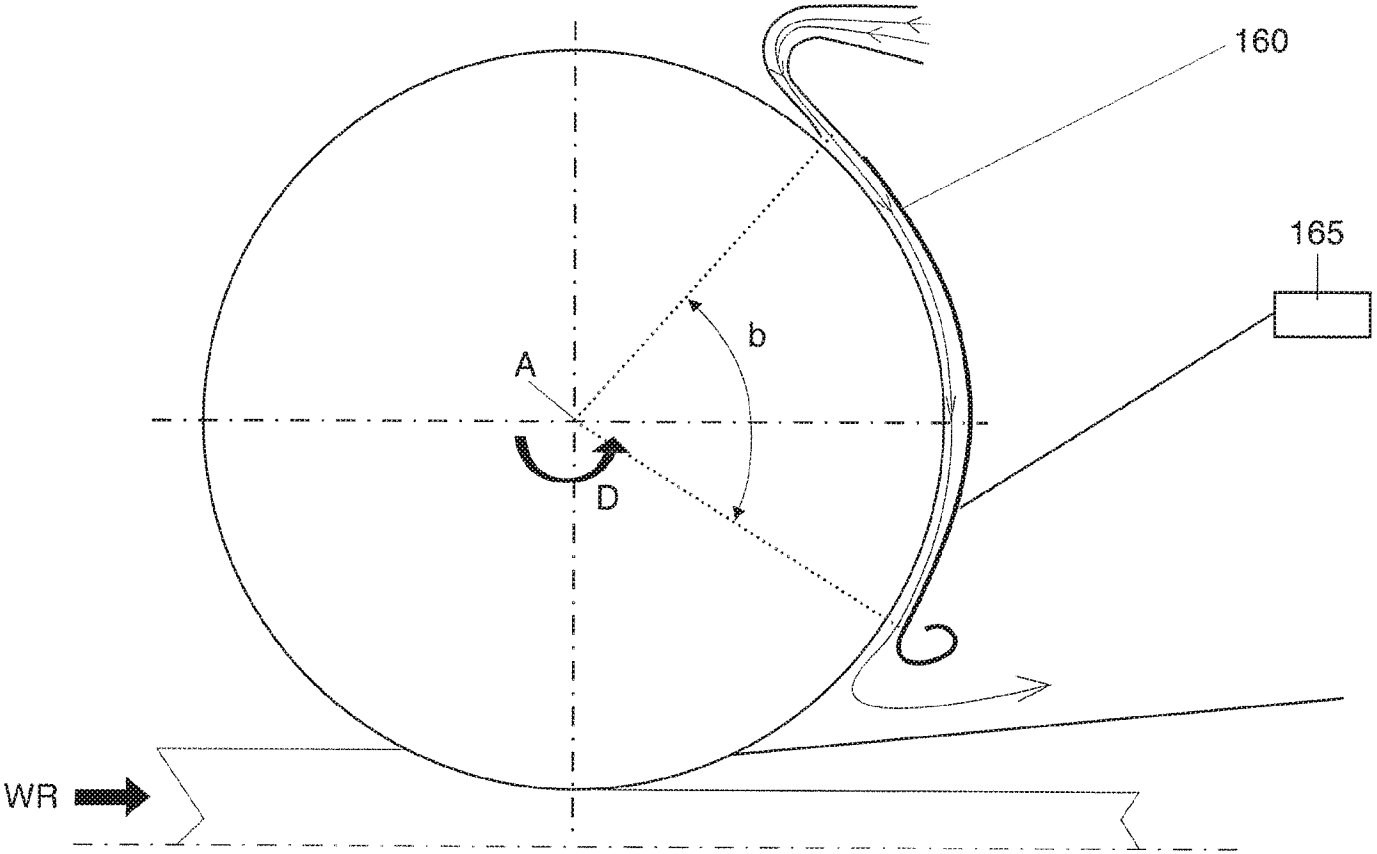
FIG. 7 the second embodiment according to FIG. 6 provided with an adjusted longer effective length.

FIG. 7 shows the cooling jacket 160 having a greater effective length b in comparison to FIG. 6, which was created so that the actuator 165 unwinds the flexible material of the cooling jacket and thus increases the cooling jacket.

Figure 8:
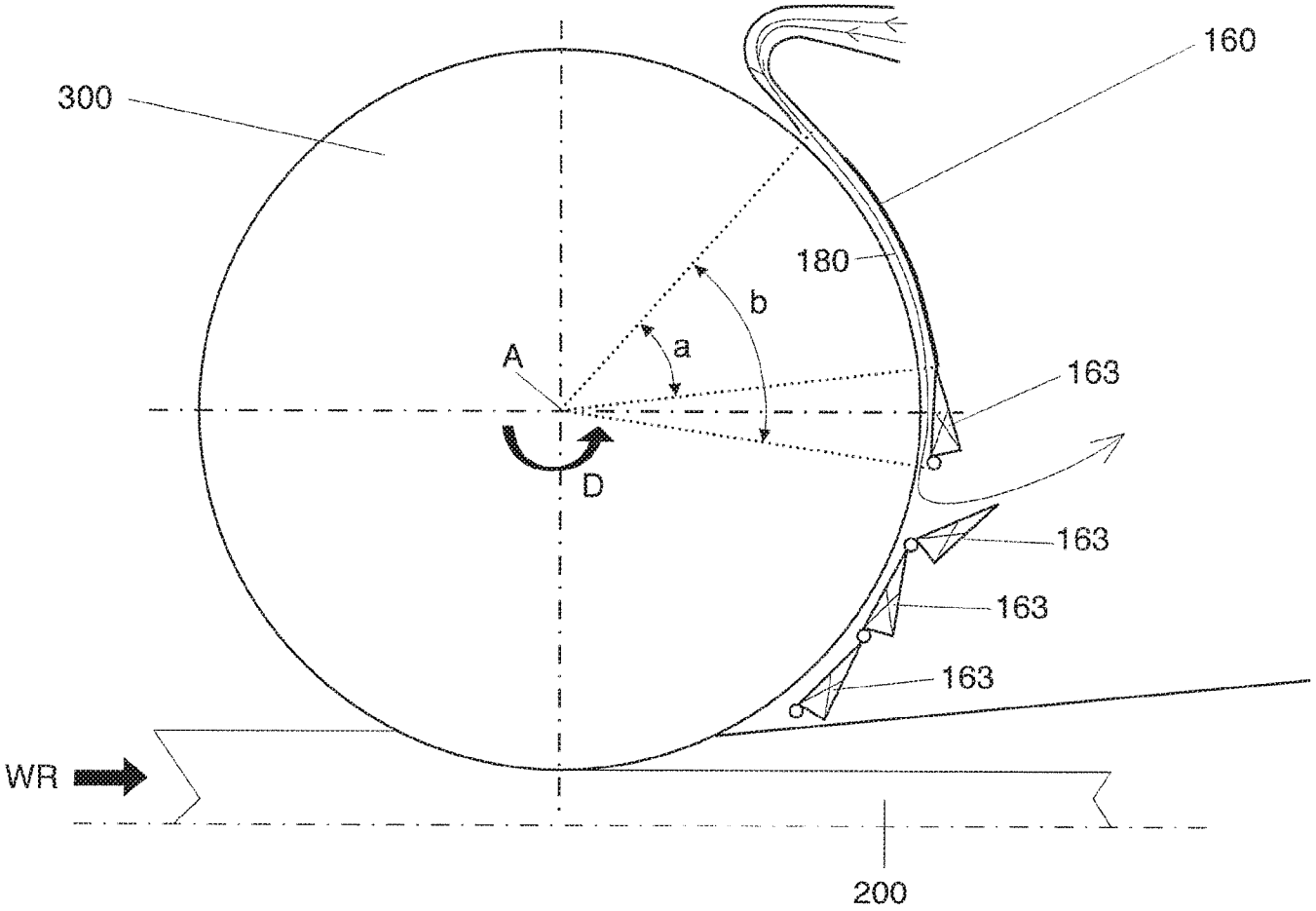
FIG. 8 a third embodiment of the cooling jacket according to the invention in a first adjustment variant.
Figure 9:
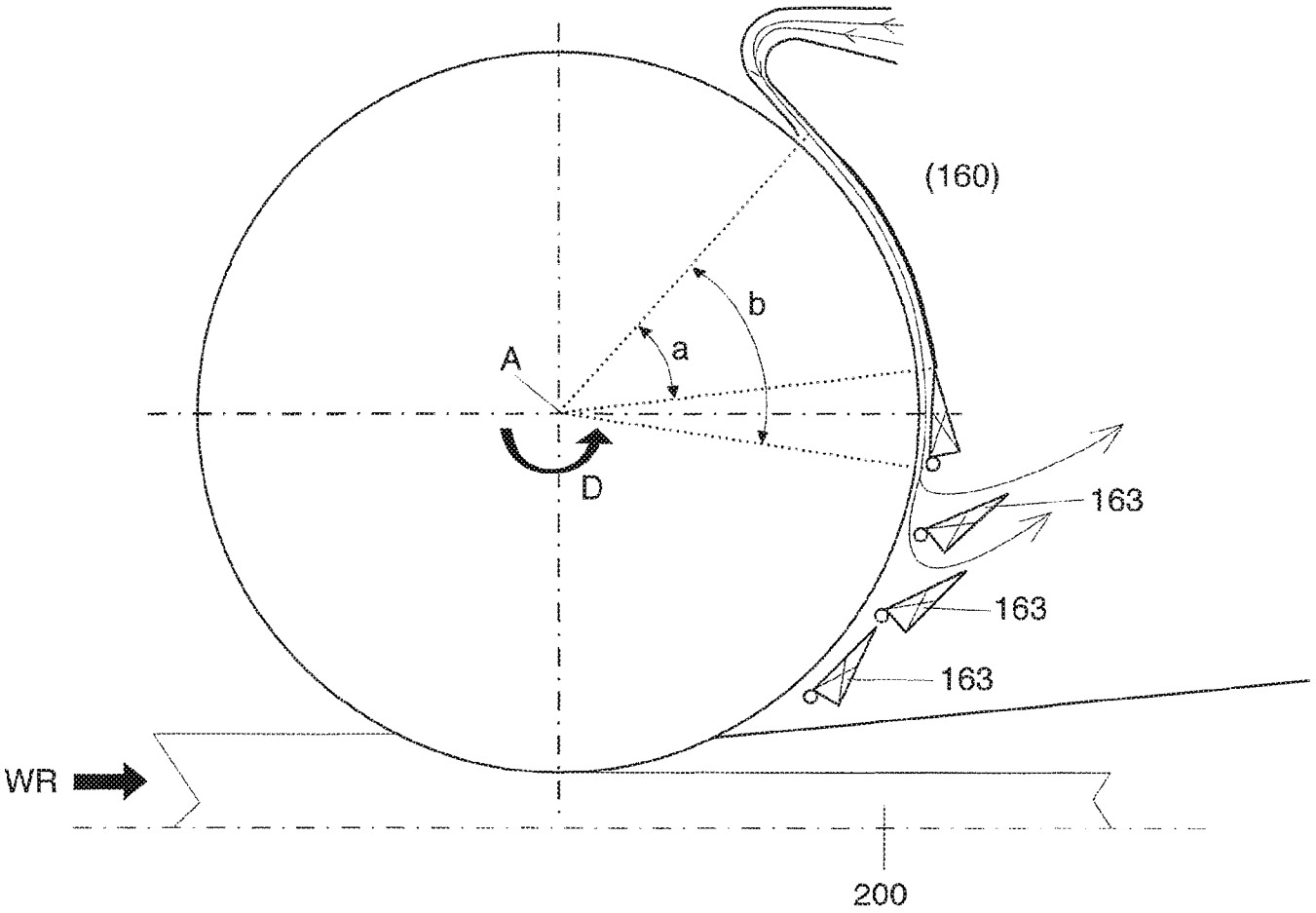
FIG. 9 the third embodiment of the cooling jacket in a second adjustment variant.
Figure 10:
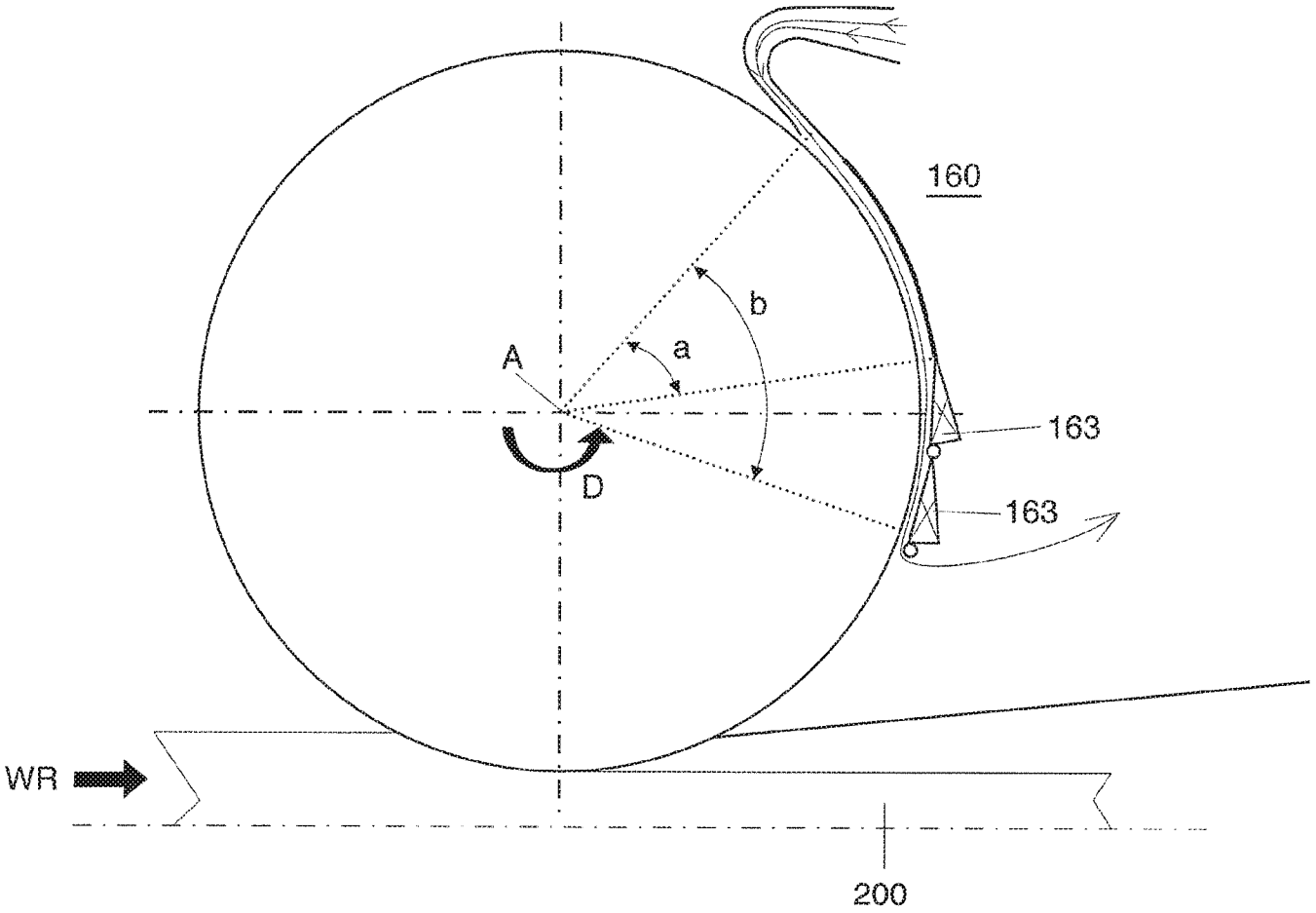
FIG. 10 the third embodiment of the cooling jacket in a third adjustment variant.
Figure 11:
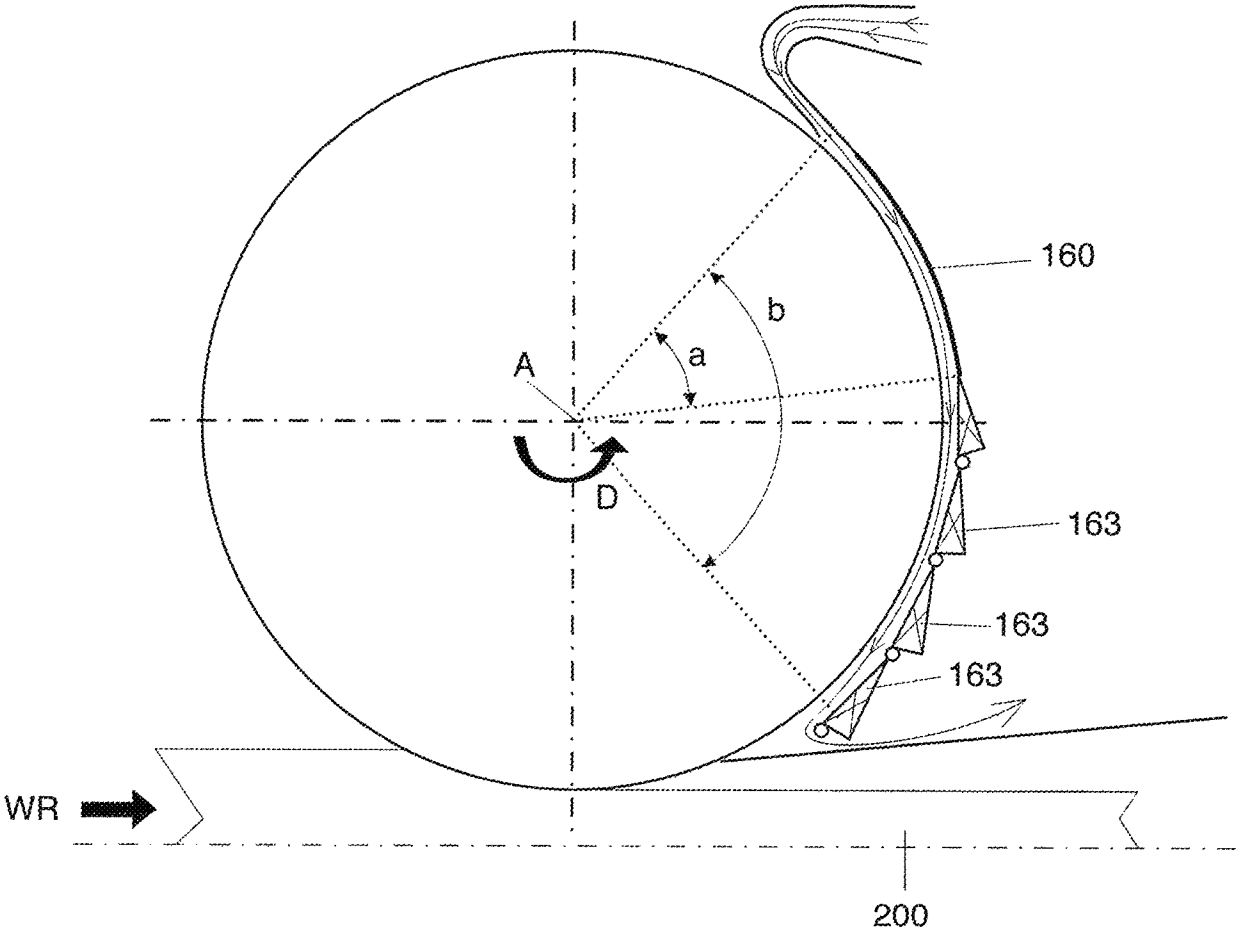
FIG. 11 the third embodiment of the cooling jacket with a fifth adjustment variant.

FIG. 8 shows a third embodiment of the cooling jacket 160 according to the invention, wherein this embodiment is provided with at least one rotatable flap, although typically with a plurality of rotatable flaps 163. An actuator 165, not shown here, is in this case designed for adjusting the effective length of the cooling jacket 160 in the circumferential direction of the roller 300 by opening or closing the at least one of the flaps 163 in accordance with the control signal s.

The respective FIGS. 8 through 11 show different variants for influencing the effective length b of the cooling jacket 160 by individually opening individual flaps 163. The flaps form a part of the surface of the cooling jacket 160 and they therefore delimit at least in the closed state the cooling gap 180.

Figure 12:
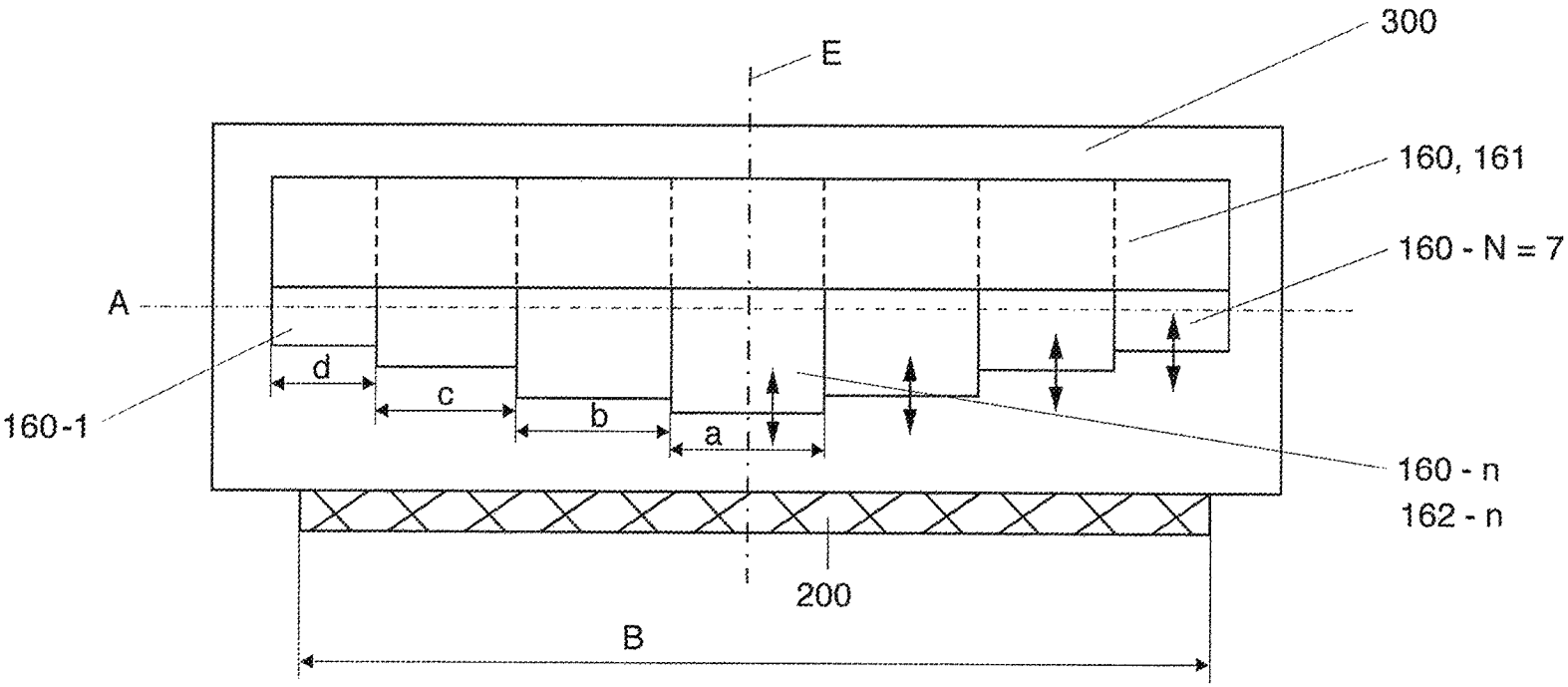
FIG. 12 a top view of a roller with a plurality of cooling jackets arranged next to each other in the axial roller direction of individual cooling jackets.

FIG. 12 shows a top view of the roller 300 with an installed cooling jacket 160. It can be seen that the cooling jackets 160 consists of a plurality N of partial cooling jackets, wherein in this case N=7, namely of partial cooling jackets **160-*n*, wherein n=1 through n=N, which are arranged next to each other in the axial direction of the roller 300 to be cooled. The actuator 165, not shown here in FIG. 12, is designed for a suitable individual adjustment of the effective length of each individual jacket 160-*n* of n cooling jackets in the circumferential direction of the roller 300 in accordance with the control deviation $e\dot{Q}$. The heat flow control deviation $e\dot{Q}$ represents in general—and thus also in the embodiment shown in FIG. 12—the distribution of the heat flow to be output by the roller 300 in the axial direction of the roller, or in the width direction B of the rolled material 200. The widths of the individual partial cooling jackets 160-*n* in the axial direction can be individually different; they are indicated in FIG. 12** by the reference symbols a, b, c and d.

The partial cooling jackets **160-*n* can also be provided with a common cooling segment 161, which is designed to be integrated in one piece so that only the second cooling jacket segments 162**-*n* can be variably adjusted in their effective length in the circumferential direction of the roller 300, as indicated by vertical double arrows in FIG. 12.

However, FIG. 12 is not limited only to the design of the cooling jackets 160 according to the first embodiment. Instead, the basic principle illustrated in FIG. 12 of the effective length b over the axial lengths of the rollers can be realized in all three embodiments used for the cooling jackets 160 as described in the present description.

The invention claimed is:

1. A method for controlling a parameter of a strip-shaped rolled stock rolled by means of a roll stand, comprising the following steps:

measuring the actual parameter $P_{actual}$ of the rolled stock after a rolling operation;

comparing the actual parameter $P_{actual}$ to a predetermined target parameter $P_{target}$ for the rolled stock and determining a deviation between the actual parameter and the target parameter control deviation;

determining a control signal for controlling at least one actuator as a function of the parameter control deviation, and providing the control signal to the actuator to perform according to the function;

wherein the actuator is a cooling jacket associated with a roller of the roll stand;

wherein the cooling jacket is designed with a variable effective length in the circumferential direction of the roller;

wherein the cooling jacket is provided with at least a first and a second cooling jacket segment, which is respectively provided with a cross-section having the form of a circular arc for covering a surface segment of the roller; and the effective length of the cooling jacket is suitably adjusted by means of the control signal in the circumferential direction as a function of the parameter control deviation, wherein in order to adjust the effective length of the cooling jacket in the circumferential direction of the roller, the first and the second cooling jacket segments are shifted relative to each other in the circumferential direction, so that they are mutually overlapping each other in accordance with the control signal, at least partially.

2. The method according to claim 1, wherein the determination of the control signal comprises the following steps:

determining a target value for the flow of the heat to be discharged from the roller based on at least the previously determined parameter control deviation determining the actual flow of the heat that is actually discharged from the roller, determining the heat flow control deviation as a difference between the target value and the actual value for the flow of the heat to be discharged from the roller; and determining the control signal for adjusting the operating length of the cooling jacket in the circumferential direction in accordance with the heat flow control deviation, which is in turn dependent on the parameter control deviation.

3. The method according to claim 1, wherein the effective length of the cooling jacket in the circumferential direction is increased when the target value of the heat flow is greater than the actual value of the heat flow;

the effective length of the cooling jacket in the circumferential direction remains unchanged when the target value of the heat flow is the same as the actual value of the heat flow;

the effective length of the cooling jacket in the circumferential direction is reduced when the target value of the heat flow is smaller than the actual value of the heat flow.

4. The method according to claim 2, wherein a determination of the actual flow of the heat comprises a determination of the distribution of the heat flow, and the parameter means the profile or the distribution of the flatness in the width direction of the rolled stock.

5. The method according to claim 1, wherein the carrying out of the method takes place in a rolling pause.

6. A method for controlling a parameter of a strip-shaped rolled stock rolled by means of a roll stand, comprising the following steps:

measuring the actual parameter $P_{actual}$ of the rolled stock after a rolling operation;

comparing the actual parameter $P_{actual}$ to a predetermined target parameter $P_{target}$ for the rolled stock and determining a deviation between the actual parameter and the target parameter control deviation;

determining a control signal for controlling at least one actuator as a function of the parameter control deviation, and providing the control signal to the actuator to perform according to the function;

wherein the actuator is a cooling jacket associated with a roller of the roll stand;

wherein the cooling jacket is designed with a variable effective length in the circumferential direction of the roller; and the effective length of the cooling jacket is suitably adjusted by means of the control signal in the circumferential direction as a function of the parameter control deviation, wherein the cooling jacket is formed from a flexible material which allows adjusting the effective length of the cooling jacket in the circumferential direction of the roller by bending at least parts of the cooling jacket away from the roller, or towards the roller, or by winding or unwinding the flexible material in accordance with the control signal.

7. A method for controlling a parameter of a strip-shaped rolled stock rolled by means of a roll stand, comprising the following steps:

measuring the actual parameter $P_{actual}$ of the rolled stock after a rolling operation;

comparing the actual parameter $P_{actual}$ to a predetermined target parameter $P_{target}$ for the rolled stock and determining a deviation between the actual parameter and the target parameter control deviation;

determining a control signal for controlling at least one actuator as a function of the parameter control deviation, and providing the control signal to the actuator to perform according to the function;

wherein the actuator is a cooling jacket associated with a roller of the roll stand;

wherein the cooling jacket is designed with a variable effective length in the circumferential direction of the roller;

wherein the cooling jacket is provided with at least one rotatable flap, and the effective length of the cooling jacket is suitably adjusted by means of the control signal in the circumferential direction as a function of the parameter control deviation by opening or closing the flap in accordance with the control signal.

* * * * *